US005660554A

United States Patent [19]

Mead

[11] Patent Number: 5,660,554

[45] Date of Patent: Aug. 26, 1997

[54] UNIVERSAL PLUG ADAPTOR

[76] Inventor: Michael S. Mead, 1170 N. Arbor (714), Anaheim, Calif. 92801

[21] Appl. No.: 573,530

[22] Filed: Dec. 15, 1995

[51] Int. Cl.[6] ..... H01R 29/00

[52] U.S. Cl. ..... 439/172; 439/956

[58] Field of Search ..... 439/170, 171, 439/172, 53, 151, 518, 143, 217, 218, 219, 220, 221, 956

[56] References Cited

U.S. PATENT DOCUMENTS 5,474,464 12/1995 Drewnicki ..... 439/143

FOREIGN PATENT DOCUMENTS 0241878 2/1961 Australia ..... 439/171

3310571 9/1984 Germany ..... 439/172

*Primary Examiner*—Neil Abrams

*Assistant Examiner*—Tho Dac Ta

[57] ABSTRACT

An electrical outlet for receiving electrical plugs of several types and providing different voltages to different plugs is disclosed.

2 Claims, 1 Drawing Sheet

UNIVERSAL PLUG ADAPTOR

FIELD OF THE INVENTION

This invention relates to electrical fixtures and, more particularly, to electrical sockets for use in hotels and the like.

BACKGROUND OF THE INVENTION

A traveler in countries throughout the world face the challenge of adapting to different electrical socket configurations and to different electrical voltage outlets in various kinds of sockets. A traveler from Europe into the United States, for example, is unable to use electrical appliances normally carried during travel, e.g. electric razors, hair dryers, curling irons, etc., in the United States without a special adaptor. Likewise, a traveler from the United States into Europe faces the same problems.

There are a number of different types of electrical sockets each having a particular spatial geometry. Even in a given country, different sockets may be found in different facilities. Sometimes the spatial geometry is intended to accept a plug and provide a specified voltage or current maximum. Sometimes the spatial geometry is provided to assure that the appliance that is plugged in is grounded.

The result of different building codes, different customs insofar as wiring plugs, etc., different voltage requirements for appliances, and the evolution of different kinds of sockets even within a given country, is that it is very difficult for a hotel, inn, motel, or other provider of lodgings to provide a source of electric energy for its guests.

The traditional solution to this problem is to require the guest to bring his or her own electrical adaptor. There are many of these available. In each case, however, it means that the guests must have previously purchased or go out and purchase a device which will adapt from the socket in the lodging facility to the plug that the guest wants to use and which will also provide the correct voltage.

The object of this invention is to provide a universal plug adaptor that will offer to the guests in a lodging facility a variety of sockets that will accept a variety of plugs and which will provide to the plug the voltage and current requirements of the appliance that carries the particular plug.

SUMMARY OF THE INVENTION

The present invention comprises a universal electrical plug adaptor that is constructed and configured to be mounted in guest rooms in lodging facilities to offer to the guests in the facility a plurality of sockets connectable to the ultimate source of electric energy. The respective sockets are adapted to receive a specific plug and to provide to that plug electric energy compatible with the requirements applicable to plugs of the particular spatial geometry. In the preferred embodiment, the universal electrical plug adaptor comprises a proximal housing that is constructed and adapted to be mounted on the wall of a guest room and to be connected to the electrical system of the facility. The proximal housing has means mounting a plurality of source electrical contacts in any pre-determined spatial relationship to each other and to the housing. Reference to source electrical contacts is intended to mean the contacts which are connected to or connectable to a source of electrical power. Circuit means are provided for connecting at least two different electrical voltages to at least two of these electrical contacts. In the preferred embodiment, three or four electrical contacts are used to permit the application of at least two different electrical voltages to different sockets. The adaptor also comprises a distal housing that is constructed and adapted to be moveably secured to the proximal housing. In the preferred embodiment, the distal housing is rotatably attached to the proximal housing, permitting the distal housing to be rotated about a central axis common to the distal and proximal housings. The distal housing has a plurality of electrical receptacles, each of which has a pre-determined spatial geometry for providing a pre-determined voltage to a plug, when a plug is inserted therein, in accordance with the requirements for supplying voltage to the plugs that are receivable in the respective receptacle. The distal housing also comprises means mounting the plurality of sets of receptor electrical contacts for selective contact with the source electrical contacts in the proximal housing. Circuit means are provided for connecting the respective sets of receptor electrical contacts to the source electrical contacts for selectively completing an electrical circuit from the source electrical contacts to the respective set of electrical contacts and the selected receptacle for providing to such receptacle a voltage compatible with the spatial geometry of the plug receivable therein.

The plug adaptor preferably comprises means mounting the distal housing on the proximal housing in rotatable relationship thereto, thus permitting the distal housing to be rotated for connecting the respective sets of electrical contacts, individually, to the source electrical contacts by rotating the distal housing relative to the proximal housing. It is also preferred to provide means for electrically isolating all of the receptor contacts from the source contacts during most of the movement of the distal housing relative to the proximal housing.

DESCRIPTION OF THE PREFERRED EMBODIMENT

Figure 1:
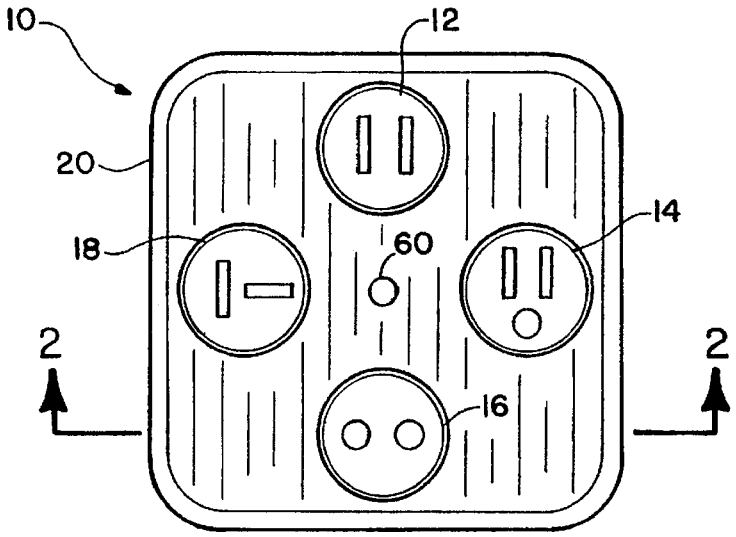
FIG. 1 is a top plan view of the electrical receptor of this invention showing a variety of exemplary sockets having, respectively, individual spatial geometries for receiving different electrical plugs having corresponding mating spatial geometries.

The drawing depicts a preferred embodiment of the invention. It is to be understood, however, that the particular spatial geometries of the electrical sockets is merely an exemplary. Also, the individual components may vary significantly from those which are depicted, somewhat schematically, in the drawings without departing from the scope of the invention.

Making reference first to FIG. 1, which is a top plan view of the universal electrical plug adaptor 10 of this invention, the drawing illustrates the top of the distal housing 20. The distal housing 20 is pivotally mounted on the proximal housing 40 which, in use, is permanently mounted to an electrical connection box, or otherwise connected to the source of electricity, the line voltage and the installation.

Exemplary pivot means 60 are provided to permit the distal housing to pivot or rotate relative to the proximal housing.

Figure 2:
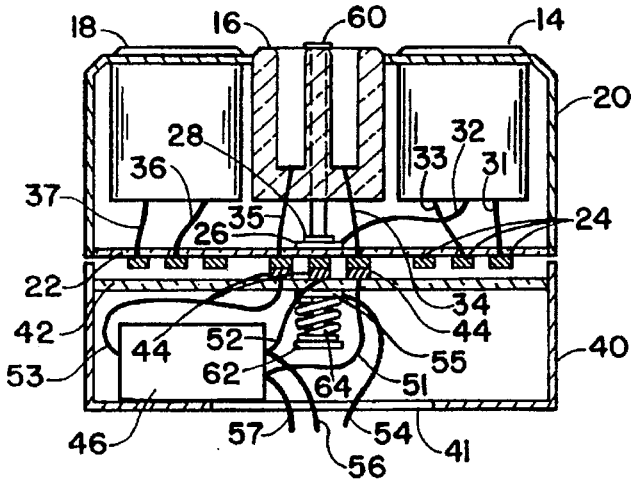
FIG. 2 is a side elevational view in cross-section taking substantially along line 2—2 in the direction of the arrows as shown in FIG. 1.

The distal housing 20 is provided with openings in which a plurality of differently configured electrical sockets indicated at 12, 14, 16 and 18, are mounted. These sockets are constructed and configured and have a spatial geometry to receive different plugs. The geometries depicted are merely exemplary and the sockets may have electrical connectors mounted in any geometric configuration to adapt to any variety of electrical plugs. Referring to FIG. 2 in particular, the distal housing carries an insulator board 22 on to which or in connection of which a plurality of electrical contacts indicated generally at 24 are mounted. In a preferred embodiment, in another electrical contact 26 retained in place by a keeper 28 is also mounted in association with the pivot means, which will be described in greater detail.

Electrical conductors 31, 32 and 33 lead from the respective electrical connectors in the plug 14 to contacts mounted on or moveable with the insulator board 22. In the exemplary embodiment, two of the conductors 31 and 33 connect to the source of voltage whereas another of the conductors 32 leads to a ground connector 26. A similar arrangement involving electrical connectors 34 and 35 is provided with respect to plug 16 and likewise, a pair of conductors 36 and 37 permit electricity to be applied to the socket 18.

Continuing to make reference to FIG. 2, the proximal housing 40 has an insulator board 42 to which a set of electrical contacts in 44 are attached with which the contacts are associated. The electrical contacts 44 are connected by electrical conductors 51, 52 and 53. At the exemplary embodiment, the conduit 53 permits electricity to be applied from a transformer 46 in the proximal housing 40 whereas the conduits 51 and 52 provide electricity directly from the line voltage indicated by the electrical conduits 56 and 57. A ground line 54 applies voltage to a connector 55 which is mounted on the pivot means 60. The pivot means 60 is, in the exemplary embodiment, a pin that extends from the outer surface of the distal housing through the two insulator boards and is provided with a keeper 62 and a spring or other originally biasing means at 64. In this embodiment, the conductor 54 extends to the ground circuit of the source of electricity and provided a grounding for the respective sockets, where the sockets are adapted to provide a ground contact. The ground connection in the exemplary embodiment is through the metal pin 60 by means of a pair of contacts 26 and 55 that make electrical contact with a pin.

It will be noted that only one set of contacts 44 is provided on the insulator board 42. The electricity which is provided through the electrical conduits 54, 56 and 57, which extend from the building wiring through an opening 41 into the proximal housing 40, is connected to the contacts 44 on the insulator board 42. Only one set of the contacts on the insulator board 22 is in electrical contact with the contacts 44 on the insulator board 42 in the proximal housing. Thus, electricity is applied to only one of the sockets in the distal housing at any given time. Any of the sockets can be selected to receive electrical power simply by rotating the distal housing with respect to the proximal housing about the pivot pin 60.

Figure 3:
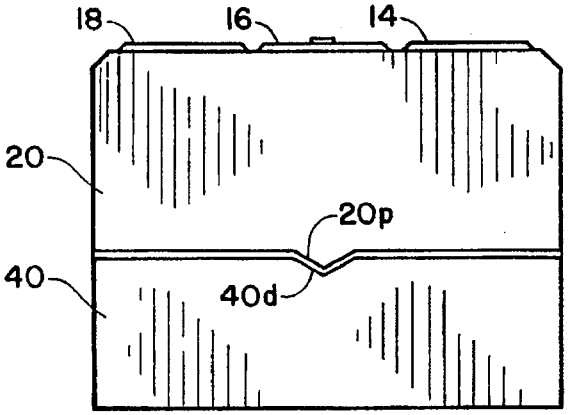
FIG. 3 is a side elevational view of the universal electrical plug adaptor of this invention depicting one means for isolating the receptor contacts from the source contacts while switching from one set of receptor contacts to the other set of receptor contacts.

Referring to FIG. 3, it is desirable to provide some means for making a quick connect and disconnect between the contacts as the contacts are rotated. In the preferred embodiment, a projection 20*p* is adapted to be received in a detent 40*d*. There are four such projections and four such detents, only one being depicted in the drawing. One is on each of the four sides of the housings. Thus, when the distal housing 20 is rotated relative to the proximal housing 40, the interaction of the projection and the detent lifts the distal housing and separates the contacts that are mounted in the distal housing from those mounted in the proximal housing breaking the circuit quickly. In the exemplary embodiment, four different styles of socket are provided, contact to permit electrical energy to be applied to the respective contacts being facilitated by the interaction of four sets of projections and detents.

It will be understood that the exemplary embodiment is intended merely to illustrate the principal of the invention and that the particular configuration of the sockets is not limiting nor even necessarily fully representative, depending where the invention is utilized. Furthermore, the housings 40 and 20 need not be square and, indeed, may be circular, hexagonal or octagonal, for example. While four sockets are illustrated as being exemplary, the housing may facilitate five or six such sockets, especially if the housing is made in a round configuration.

It will also be understood that the invention need not require the detent and projection arrangement and that other means may be provided for locating the distal housing relative to the proximal housing so as to provide a desired electrical voltage to a particular socket.

In general, it will be understood that the exemplary embodiment is not all encompassing and that the scope of the invention is limited only by the claims herein.

INDUSTRIAL APPLICATION

This invention relates to the electrical power industry.

What is claimed is:

1. A universal electrical plug adaptor constructed and configured to be mounted in guest rooms in facilities that provide lodging, said plug adaptor comprising, in combination:

(a) a proximal housing (40) constructed and adapted to be mounted on the wall of a guest room and to be connected to the electrical system in a facility providing such guest rooms, the proximal housing comprising:

(1) means (42) mounting a plurality of source electrical contacts (44) in predetermined spatial relationship to each other; and (2) circuit means (46, 51–57) for providing at least two different voltages to at least two of said electrical contacts;

(b) a distal housing (20) constructed and adapted to be moveably secured to the proximal housing, the distal housing comprising:

(1) a plurality of electrical receptacles (12, 14, 16, 18), the respective receptacles having a predetermined spatial geometry for providing a predetermined voltage in accordance with requirements for supplying voltage to plugs receivable in a respective receptacle;

(2) means mounting a plurality of sets of receptor electrical contacts (24) for selectively contact with the source electrical contacts in the proximal housing; and (3) circuit means (31–37) connecting respective sets of receptor electrical contacts to the source electrical contacts for selectively completing an electrical circuit from the source electrical contacts to the respective set of receptor electrical contacts to one of the electrical receptacles for providing to such receptacle a voltage compatible with the spatial geometry of the plug contacts therein; and (c) means mounting the distal housing rotatably relative to the proximal housing for individually bringing the respective sets of receptor electrical contacts into electrical contact with the source electrical contacts as the distal housing is rotated relative to proximal housing.

2. The plug adaptor of claim 1 further comprising means for electrically isolating the receptor contacts from the source contacts during movement of the distal housing relative to the proximal housing.

* * * * *